United States Patent [19]

Szadkowski

[11] 4,199,086

[45] Apr. 22, 1980

[54] CLOSED LOOP TRACK SLIDE GATE MECHANISM

[75] Inventor: Stanislav Szadkowski, Brussels, Belgium

[73] Assignee: Vesuvius International Corporation, Wilmington, Del.

[21] Appl. No.: 956,940

[22] Filed: Nov. 2, 1978

[30] Foreign Application Priority Data

Nov. 15, 1977 [GB] United Kingdom ..... 47514/77

[51] Int. Cl.[2] ..... B22D 41/08

[52] U.S. Cl. ..... 222/600; 222/512; 251/187

[58] Field of Search ..... 164/437; 251/187, 206; 222/598, 600, 512, 545, 555, 557, 560, 561

[56] References Cited

U.S. PATENT DOCUMENTS

| | | | |
|---|---|---|---|
| 3,430,644 | 3/1969 | Lyman | 222/598 |
| 3,565,299 | 2/1971 | Bieri | 222/598 |
| 3,730,401 | 5/1973 | Bode, Jr. | 222/600 |
| 3,921,866 | 11/1975 | Palazzo | 222/598 X |

*Primary Examiner*—David A. Scherbel

*Attorney, Agent, or Firm*—Sughrue, Rothwell, Mion, Zinn and Macpeak

[57] ABSTRACT

The invention provides a slide gate mechanism for use on a pour vessel to control flow of molten metal through at least one outlet in the vessel shell, whereby refractory insert plates which are conveyed by said mechanism may be moved in very close cooperating contact with a perforated refractory outlet plate for the pour vessel, so as to control the flow of molten metal therethrough.

26 Claims, 6 Drawing Figures

CLOSED LOOP TRACK SLIDE GATE MECHANISM

SUBJECT-MATTER OF THE INVENTION

This invention relates to a slide gate mechanism for controlling flow of molten metal from a vessel containing such molten metal, hereinfurther referred to as a "pour vessel".

More particularly it relates to such a mechanism comprising refractory plates which may be moved in front of a refractory outlet plate for the pour vessel, whereby there is always provided a close cooperating contact between the refractory outlet plate for the pour vessel and that refractory plate of the slide gate mechanism, which is moved or positioned in front of it.

THE PRIOR ART

Slide gate mechanisms for use on pour vessels for molten metal, comprising more than one refractory plate which may be moved in front of a refractory outlet of the pour vessel, are already known in the art of casting metals.

Thus, there is known a rotary gate mechanism for a pour vessel which includes a rigid valve or gate, comprising a plurality of removable refractory inserts rigidly retained therein, whereby said rigid valve is urged against the outlet in the vessel by means of one single centrally located spring. Such a known mechanism has however the drawback that its rigid construction and the central position of the spring therein, do not allow a sufficiently close and tight contact between the refractory inserts and the outlet of the vessel; this may result in leakage of molten metal during the pouring.

Furthermore, in the known slide gate mechanisms the pushing systems urging the slide gates against the outlet in vessel, are arranged at or near the working position of said slide gates, which means in the vicinity of the vessel outlet, and in the heat radiating area thereof. This arrangement results in a substantial vulnerability of the pushing system. The slide gate mechanisms comprising more than one refractory plate, presently known, are further also very cumbersome with respect to the space they occupy on the vessel shell.

BRIEF DESCRIPTION OF THE INVENTION

It is an object of the present invention to provide a slide gate mechanism for use on a pour vessel for molten metal which avoids the above drawbacks of the known mechanisms, allows pouring or casting of metal in a much easier way and opens new, unexpected possibilities in the field of pouring or casting metal.

This new slide gate mechanism therefor comprises movable carriages conveying refractory insert plates in a free swiveling manner in front of the vessel outlet or outlets, and a lever pushing system for urging, from outside the heat radiating area of said outlet, said refractory insert plates towards said outlet, when they are in the vicinity of the outlet.

DETAILED DESCRIPTION OF THE INVENTION

The slide gate mechanism, according to the invention, for use on a pour vessel to control flow of molten metal through at least one outlet in the vessel shell, comprises:

—a guiding system defining a closed loop path which runs substantially perpendicular to the axis of the outlet or outlets in the vessel shell, fixed to the vessel shell or to a mounting plate attached thereto;

—a plurality of movable carriages supported and guided along said closed loop path by said guiding system;

—a plurality of refractory plate supporting frames, each connected to one carriage on the carriage side facing the outside of said closed loop path, by means of a connection allowing each supporting frame to swivel on the one end in a rotation plane which is perpendicular to said closed loop path, and on the other end around a rotation axis which is perpendicular to the axis of the rotation of said supporting frame in said perpendicular rotation plane;

—a plurality of interchangeable refractory insert plates each supported by one supporting frame in such a manner that each refractory plate is able to swivel around an axis which is substantially parallel to the axis of the rotation of said supporting frame in said perpendicular rotation plane, whereby at least one of said refractory plates has an aperture which may be brought in alignement with the outlet or outlets in the vessel shell and whereby the movement of the carriages and the lateral edges of the refractory insert plates are so adapted that the refractory insert plates conveyed by two adjacent carriages form with respect to each other a substantially tight seal, when positioned or moving in front of one outlet in the vessel shell;

—a pushing system urging said refractory plate supporting frames, when they are in the vicinity of the outlet or outlets in the vessel shell, towards said outlet or outlets, said system comprising at least one lever and force supplying means, removed from the heat radiating area of said outlet or outlets, acting on said lever or levers;

—driving means for moving said carriages along said closed loop path;

whereby the refractory insert plates may be moved in very close cooperating contact with a perforated refractory plate for the outlet or outlets in the vessel shell, so as to control the flow of metal therethrough.

According to one preferred feature of the invention, the slide gate mechanism thereof may, as a whole, be connected to and removed from said pour vessel on which it is to be used.

In one specific embodiment of the slide gate mechanism according to the invention, the guiding system of said slide gate mechanism consists of two parallel guiding rails.

According to a particular and preferred feature of this embodiment of the slide gate mechanism of the invention, the two parallel guiding rails are superimposed so as to form a closed loop track, the surface of which is substantially parallel to the axis of the outlet or outlets in the vessel shell.

According to another preferred feature of this embodiment, each carriage comprises four supporting means, two of which are supported and guided by each guiding rail, in particular four wheels rolling in the track of said rails.

In a further embodiment of the slide gate mechanism of the invention, each movable carriage is provided with a supporting frame support hinged thereto by means of a connection allowing said supporting frame support to swivel in a rotation plane which is perpendicular to said closed loop path whereby each supporting frame support is connected to one supporting frame support by means of a spindle of said supporting frame extending into a corresponding bore of said supporting frame support, in a direction which is perpendicular to the axis of the rotation of said supporting frame support in said perpendicular rotation plane, thus allowing the swiveling movement of said supporting frame around a rotation axis coinciding with said perpendicular direction, whereby the supporting frame support is able to swivel, together with said supporting frame in said perpendicular rotation plane.

According to a particular feature of this latter embodiment of the invention, each supporting frame support may be connected to the movable carriages by means of coaxial spindles extending in corresponding bores, in a direction perpendicular to the perpendicular rotation plane of said supporting frame support, thus allowing the swiveling movement of said supporting frame support together with said supporting frame in said perpendicular rotation plane.

In a further embodiment of the slide gate mechanism according to the invention, each refractory insert plate bears upon one supporting frame by means of a hinge, the swivel axis of which is substantially parallel to the axis of the rotation of said supporting frame in said perpendicular rotation plane, whereby according to particular features of the invention, each refractory insert plate comprises two coaxial pins adapted to pivot in two notches of one supporting frame, or each refractory insert plate comprises two notches adapted to pivot on two coaxial pivots of one supporting frame.

In still a further embodiment of the slide gate mechanism according to the invention, the lever or levers of the pushing system urging the refractory plate supporting frames, when they are in the vicinity of the outlet or outlets in the vessel shell, towards said outlet or outlets, each have their respective fulcrum located between the point where the lever urges said refractory plate supporting frames and the point where said force supplying means act upon said lever, whereby according to particular features of the invention the lever or levers may act upon the refractory plate supporting frame or on the supporting frame support.

According to one other particular feature of the invention, each lever comprises near its end acting upon the refractory plate supporting frames, a transverse beam, the length of which is such that it can only be in contact with one refractory plate supporting frame or supporting frame support at the same time.

In one further specific embodiment of the slide gate mechanism according to the invention, the pushing system urging the refractory plate supporting frame or frames, in the vicinity of one outlet in the vessel shell, comprises three levers, each of said levers being provided with independent force supplying means, whereby one of said levers urges the refractory plate supporting frame located or moving in front of the outlet in the vessel shell, whereas the two remaining levers are adapted to urge the refractory plate supporting frames approaching and leaving the position in front of the outlet.

According to a particular feature of the invention, the fulcrum of each pushing lever is positioned in the inner area of the closed loop path, whereby one extremity of each lever is adapted to urge said refractory plate supporting frames towards one outlet in the vessel shell, whereas the other extremity of each lever extends in opposite direction to a point removed from the heat radiating area of said outlet, where the force supplying means are located.

According to the invention, the force supplying means of the slide gate mechanism may be selected among springs, hydraulic or pneumatic jacks, counterweights, magnets, electromagnets and the like.

The refractory plate supporting frames may in particular consist of forks supporting, in a free swiveling manner, the lateral edges of said refractory insert plates.

In a further specific embodiment of the slide gate mechanism according to the invention, the driving means for moving said carriages along said closed loop path comprise an endless driving chain dragging said carriages, actuated by a motor, whereby the motor may in particular be an electromotor and whereby the connection of the driving chain to the carriages may in particular be achieved by means of parts which are common to the driving chain and to the carriages.

According to further features of the invention, the movement of the carriages along said closed loop track may perform in both directions and/or at two or more different speeds.

In a further preferred embodiment of the slide gate mechanism according to the invention, apertures of different shapes and/or cross sections are provided in at least one of said refractory insert plates, whereby at least one of said refractory insert plates is adapted to close an outlet in the vessel shell in front of which it is moved or positioned, thus allowing regulation of the flow of molten metal through an outlet in the vessel shell by selecting the refractory insert plate and/or refractory insert plate portion to be positioned in front of the outlet.

In accordance with the invention, at least one of the refractory insert plates of the slide gate mechanism of the invention may have an entirely closed surface of refractory material.

In accordance with a preferred feature of the invention, the slide gate mechanism may comprise four or more carriages, each conveying one refractory insert plate, arranged along the periphery of the closed loop path.

FIGURES

Other features and details of the invention will appear from the following detailed description, in which reference is made to the attached drawings which represent, by way of a purely illustrative example, one specific embodiment of the slide gate mechanism according to the invention.

In these drawings.

In these various figures like reference characters are employed to designate the same parts.

Figure 1:
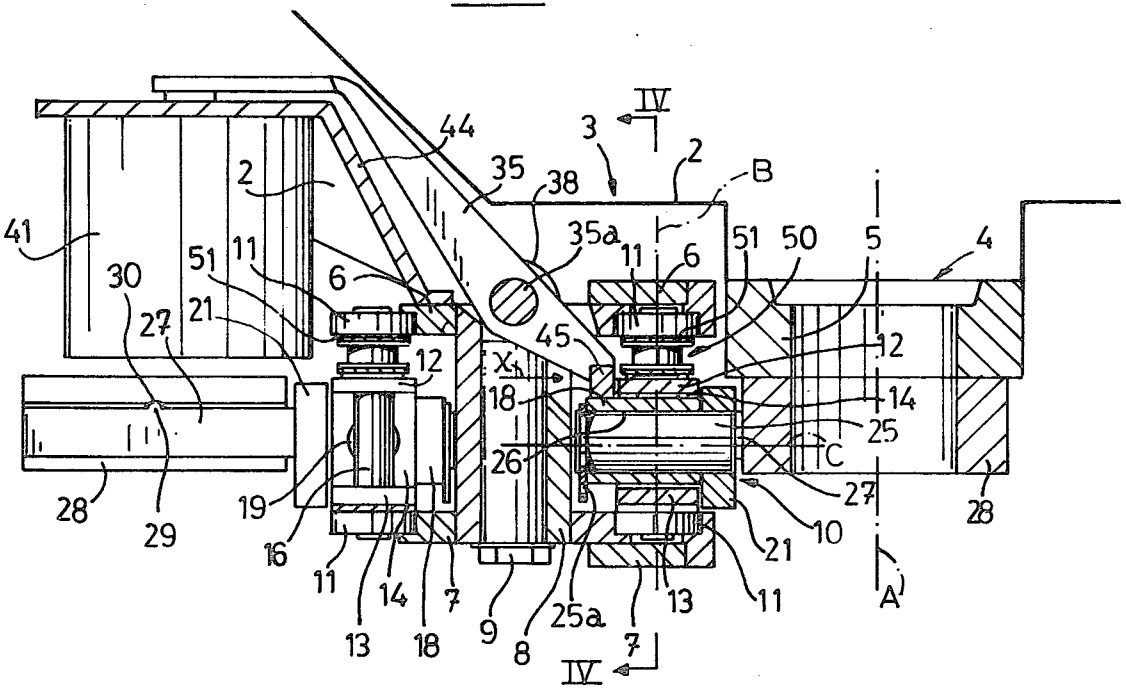
FIG. 1 is a sectional side view of one embodiment of the slide gate mechanism according to the invention, along the line I—I of FIGS. 2 and 3.

The slide gate mechanism according to the invention, as shown in particular in FIGS. 1 to 5, designated as a whole by the reference character 1, is arranged on an outer shell 2 of a pour vessel for molten metal, designated as a whole by the reference character 3, comprising an outlet 4.

The slide gate mechanism according to the invention, as shown in particular in FIGS. 1 to 5, comprises two superimposed parallel guiding rails 6, 7, defining a closed loop track, the surface of which is substantially parallel to the axis A of the vessel outlet 4, and the path of which runs substantially perpendicular to said axis A of the vessel outlet 4 and parallel to the surface of a refractory plate 5 (so-called "upper plate") which is positioned at said vessel outlet 4.

The rails 6, 7 are connected to a central frame 8, fixed to a mounting plate (not shown) on the vessel shell 2 by means of bolts 9 and 9*a*.

The slide gate mechanism according to the invention, as shown in particular in FIGS. 1 to 5, further comprises a number of carriages, indicated by the reference character 10, which in the embodiment shown are more particularly at the number of seven, each guided along said rails 6, 7 by four wheels 11.

Figure 4:
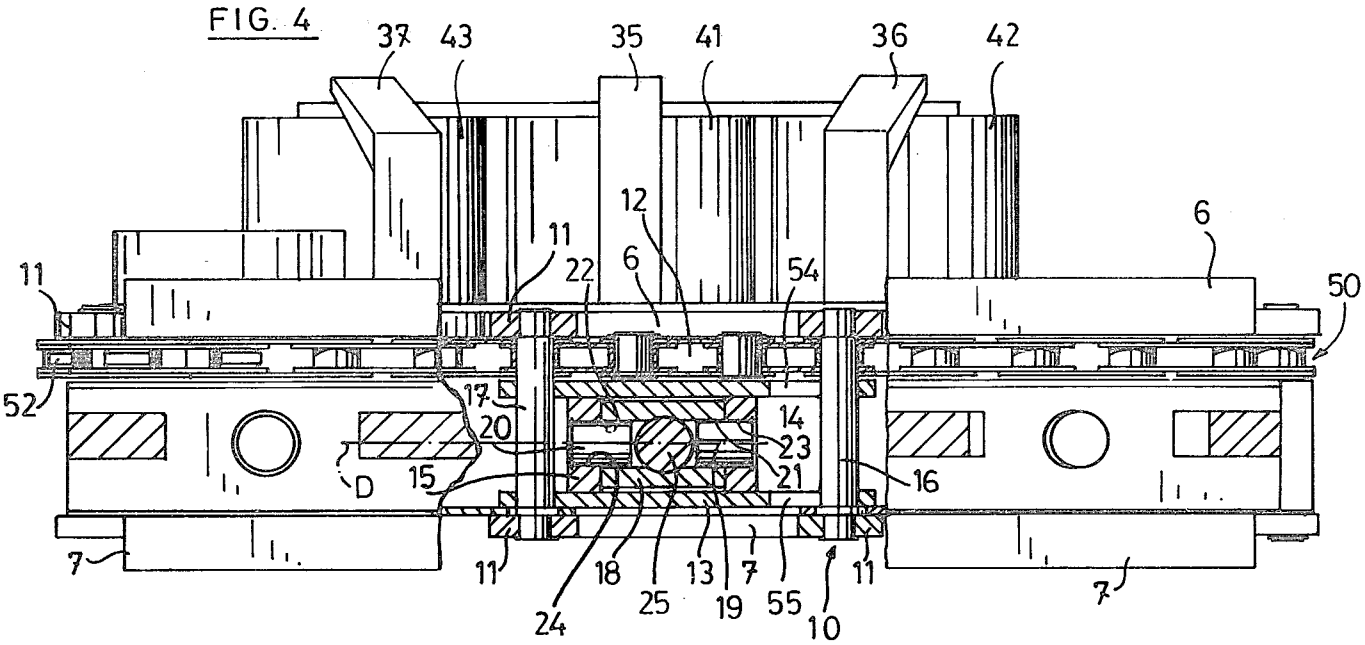
FIG. 4 is a front side view of the mechanism of FIGS. 1 to 3, partially in section along the line IV—IV of said FIGS. 1 to 3.
Figure 5:
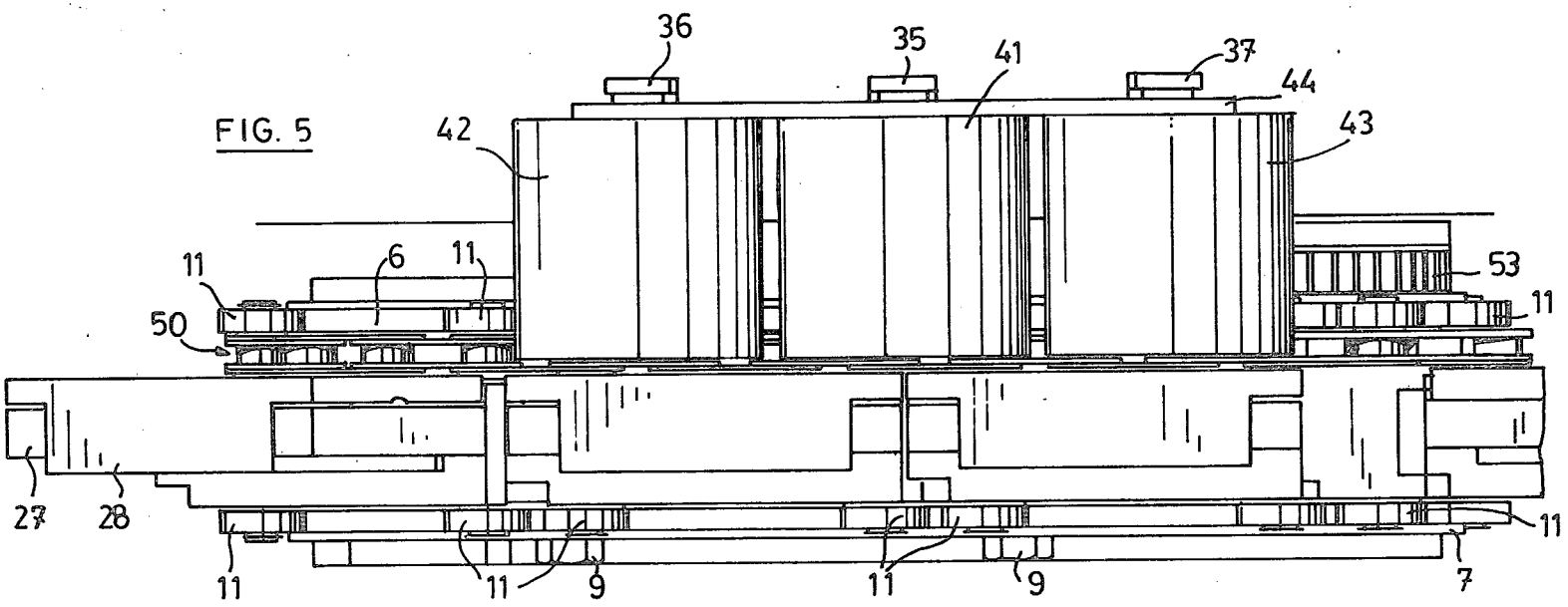
FIG. 5 is a back side view of the mechanism of FIGS. 1 to 4.

As shown more particularly in FIG. 4, each carriage 10 consists of two parallel side-members 12, 13, two cross-members 14, 15, connecting said side members 12, 13 to each other, and two axles 16, 17, engaged through said side members 12, 13 and carrying at their extremities the wheels 11.

In each carriage 10 is hinged a supporting frame support 18, by means of two spindles 19, 20 (FIG. 4) engaged into bores 21, 22 in said supporting frame support 18 and bores 23, 24 in the cross members 12, 13. This latter arrangement of the supporting frame supports 18 with respect to the carriage 10, allows the free swiveling movement of the supporting frame supports 18 in a plane B-C (defined by two lines B and C) substantially parallel to the axis A of the vessel outlet 4.

Each supporting frame support 18 carries a refractory plate supporting frame 21, connected to said supporting frame support 18 by means of a spindle 25 engaged in a corresponding bore 26 in said supporting frame support 18, and retained in said bore by an U-shaped linch pin 25*a*, whereby a washer (not represented) may be provided between the surface of the supporting frame support 18 and the surface of the refractory plate supporting frame 21.

This arrangement of the supporting frame 21 with respect to the supporting frame support 18 makes possible the free swiveling movement of the supporting frame 21 around the axis C which is perpendicular to the axis D of the rotation of the supporting frame support 18 in the rotation plane B-C, in addition to the swiveling movement of said supporting frame support 18 together with said supporting frame in said rotation plane B-C.

Each supporting frame 18 ends in a refractory plate supporting fork 27, supporting one refractory insert plate 28, through two coaxial pivots 29 on said supporting fork 27, onto which pivots 29 are engaged two fitting slots 30 in the refractory insert plates 28. This arrangement of the refractory insert plates 28 with respect to the supporting fork 27 and supporting frame 21, allows each refractory insert plate 28 to swivel around a rotation axis E centered in said pivots 29, which is substantially parallel to the axis D of the rotation of the supporting frame support 18 and the supporting frame 21 in the rotation plane B.

The shape and size of the refractory insert plates 28 conveyed by the carriages 10 in a closed loop path, are so adapted that each pair of lateral edges 28*a* of two refractory insert plates 28 conveyed by two adjacent carriages 10 form with respect to each other a substantially tight seal for molten metal in the area of the vessel outlet, thanks further to a lining of for instance ceramic refractory wool, provided on said lateral edges 28*a*.

In the rotary slide gate mechanism shown in FIGS. 1 to 5, two refractory insert plates 28 have an entirely closed surface of refractory material 31, whereas the five remaining refractory insert plates 28 are provided with apertures of three different cross sections 32, 33, 34.

The slide gate mechanism according to the invention, shown more particularly in FIGS. 1 to 5, further comprises one central lever 35, urging the refractory plate 28 which is located or moving in front of the vessel outlet 4, and two lateral levers 36 and 37, urging the refractory plates 28 which are approaching and leaving the position in front of the vessel outlet 4.

Said pushing levers 35, 36, 37 are hinged on three spindles engaged in three spindle-supports 38, 39, 40, whereby the spindle of the central lever 35, shown in FIG. 1, is designated by the reference 35*a*.

Each of said pushing levers 35, 36, 37 is provided with an independent force supplying means 41, 42, 43 such as a spring or jack, attached to a holding frame 44 which is fixed to the outer surface of the upper rail 6, whereby each independent force supplying means 41, 42, 43 is adapted to exert a pushing force on the extremities of the respective pushing levers 35, 36, 37 remoted from the vessel outlet.

At their extremities near the vessel outlet the pushing levers 35, 36, 37 are each provided with transverse beams 45, 46, 47 adapted to transmit the pushing force of the force supplying means 41, 42, 43 to those supporting frame supports 18 of the carriages 10, and to those refractory insert plates 28 conveyed by the carriages 10, which are located or moving at, and respectively approaching, and leaving the position in front of the vessel outlet 4, so as to urge said refractory insert plates 28 towards said vessel outlet 4.

Figure 6:
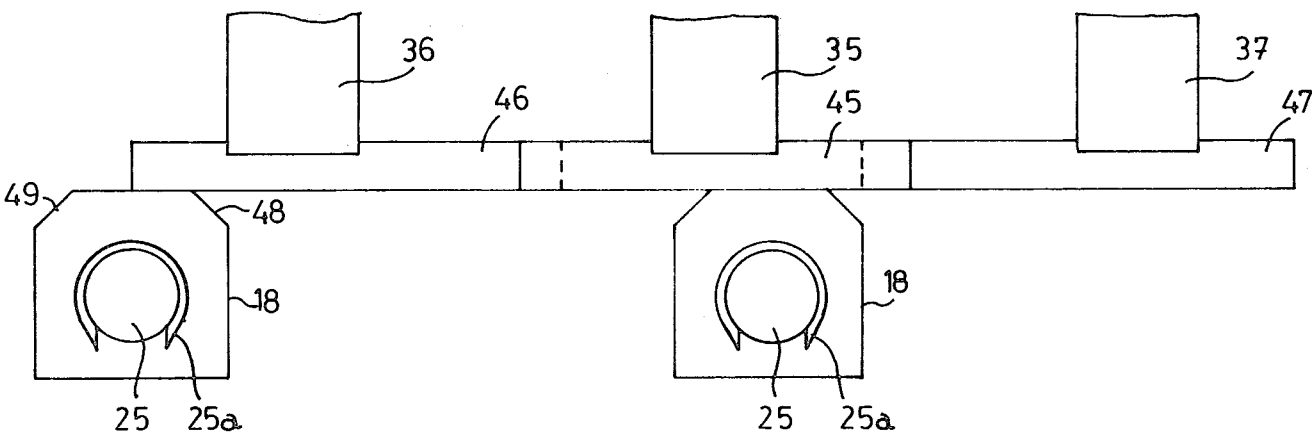
FIG. 6 is an enlarged side view in direction of arrowhead X in FIGS. 1 and 2, of the extremities of the pushing levers of the mechanism according to FIGS. 1 to 5.

The transverse beams 45, 46, 47 of the pushing levers 35, 36, 37, which transmit the pushing forces of the individual force supplying means 41, 42, 43 of said respective pushing levers 35, 36, 37, to the supporting frame supports 18 located and moving underneath said beams 45, 46, 47, each have their respective lengths so adapted that each transverse beam 45, 46, 47 can only be in contact with one supporting frame support at the same time, as shown more particularly in FIG. 6.

Figure 2:
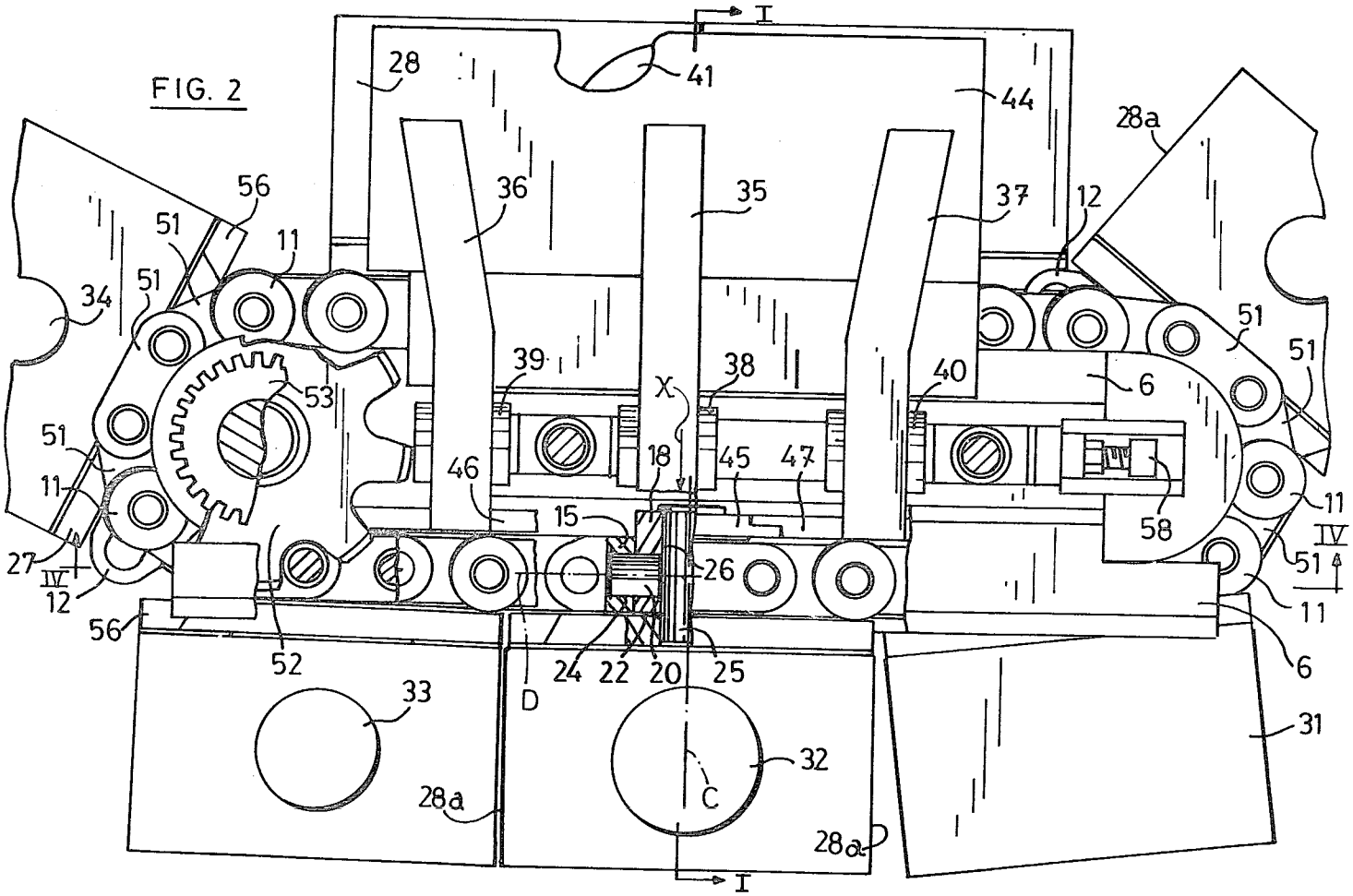
FIG. 2 is a top plan view with partially removed and partially sectioned parts, of the slide gate mechanism of FIG. 1.
Figure 3:
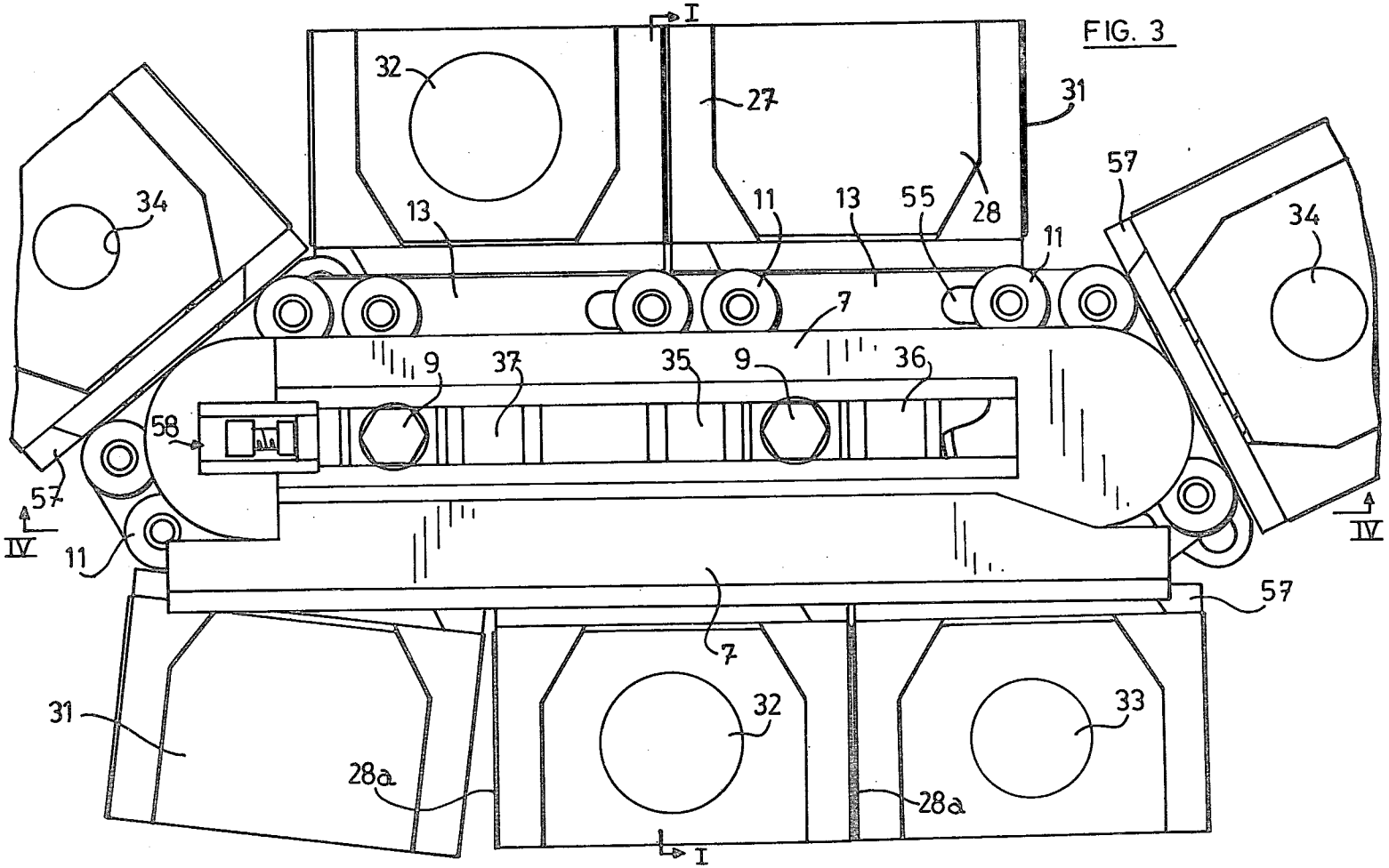
FIG. 3 is a bottom plan view of the slide gate mechanism of FIGS. 1 and 2.

As shown in particular in FIG. 2 the lateral transverse beams 46, 47 are partially superimposed, in the direction of arrow-head X, to the central transverse beam 45, and as shown in particular in FIG. 6, each supporting frame support 18 has an upper surface which is bevel-edged at both sides to inclined surfaces 48, 49.

This particular arrangement of the upper surface of the supporting frame supports 18, does allow said supporting frame supports 18 to more easily engage under the lower surface of the lateral beams 46 or 47 when approaching such beams 46 or 47, and to more easily pass from a contact with the lower surface of the lateral beams 46 or 47 to a contact with the lower surface of the central beam 45, without any undesired discontinuity in the urging of the refractory plate supporting frames 21 and refractory insert plates 28 towards the vessel outlet 4, when the supporting frame supports 18 move underneath the lower surface of the transverse beams 45, 46, 47.

The slide gate mechanism according to the invention, as shown in particular in FIGS. 1 to 5, further comprises an endless driving-chain 50, consisting of twenty eight interconnected chain-links 51, whereby each first and each fourth chain-link 51 use the carriage axles 16 and 17 as chain link axles.

This arrangements allows forward movement of the carriages 10 along the rails 6, 7 of the closed loop track, by imparting a movement to the endless chain 50, by means of a rotary cog-wheel 52, engaging between the chain-links 51 of said chain. Said cog-wheel 52 is rigidly locked to a driving gear-wheel 53 which is actuated by a driving and transmission system (not shown), known per se.

Thus the driving and transmission system may for instance consist of an electromotor and gear wheels, able to impart a rotary movement to the gear-wheel 53 attached to the cog-wheel 52, and thus to the driving-chain 50.

In particular said driving and transmission system may have two or more forward and reverse speeds so as to allow the slide gate mechanism according to the invention to be operated in both directions at two or more different speeds. In order to allow the carriages 10 of the slide gate mechanism according to the invention, as shown more particularly in FIGS. 1 to 5, to approach and to take the turnings of the closed loop track, as illustrated more particularly in FIGS. 2 and 3, one of the two axles 16, 17 of each carriage 10 is engaged through ablong stud holes 54, 55 provided in the side-members 12, 13 of said carriages, thus allowing the reduction of the linear distance between the two axles 16, 17, caused by the fact that the chain-links 51, to which said axles 16, 17 are connected, take a curved path in following the curved closed loop track.

For the same reasons of taking the turnings of the closed loop track, the supporting frame supports 21 are further also provided with recesses 56, 57, allowing the extremities of the side-members 12, 13 to swing out in the curves of the closed loop track as a consequence of the arrangement of the axles 16 through the stud holes 54, 55, without running into said supporting frame supports 21.

The mechanism according to the invention, as shown in FIGS. 1 to 5, is furthermore provided with a compensation and regulation system for the chain tension, designated by the reference 58.

The refractory insert plates 28 of the slide gate mechanism according to the invention may further be provided with a (not represented) steel envelope protecting the surfaces of the refractory insert plate 23 which are in contact with the fork 27 of the supporting frame support 21.

The entire slide gate mechanism according to the invention shown in particular in FIGS. 1 to 5 may, in a convenient manner, be installed as a whole on, and removed as a whole from the pour vessel 3 by screwing or unscrewing the two retaining bolts 9, 9*a* of the mechanism to or from the mounting plate (not shown) on the vessel shell 2.

Further, each refractory plate 28 may easily be removed from its supporting fork 27 and/or replaced by another plate 28, which may be convenient for instance when a refractory plate has become worn or damaged, or when a refractory plate 27 having an aperture of another cross section and/or shape is needed.

The slide gate mechanism according to the invention, as shown in particular in FIGS. 1 to 4 is operated by imparting a movement to the carriages 10 along the rails 6, 7 of the closed loop track, through the driving-chain 50, actuated by means of the cog-wheel 52 and the driving gear-wheel 53, so as to bring one refractory insert plate 28, and possibly one aperture therein, of suitable cross section and/or shape (32, 33 or 34) in front of the aperture in the outlet upper plate 5.

Thanks to the constant positive pushing force of the levers 35, 36, 37 and the free swiveling suspension of the refractory insert plates 28 in more than one direction, said plates 28 approach their work position at the vessel outlet 4, in a self adjusting position in respect to the surface of the upper plate 5.

When during pouring the flow of molten metal has to be modified or interrupted, the carriages of the slide gate mechanism are brought into movement so as to bring the desired refractory plate 28 or refractory plate portion in front of the vessel outlet 4. In this connection it must be emphasized that according to the relative shape and/or cross section of the apertures in the refractory insert plates and to the size of the refractory insert plates themselves, more than one aperture may be provided in each refractory insert plate 28, so that in order to modify the flow of molten metal it could be sufficient to move the mechanism of the invention to only such an extent that another aperture of the same refractory insert plate 28 is brought in front of the vessel outlet 4; in the same manner it may be possible, in order to interrupt the flow of molten metal, to position a refractory insert plate 28 in front of the vessel outlet 4 in such a way that a closed portion of said refractory insert plate 28 closes the vessel outlet 4; it must further also be emphasized that in order to modify the flow of molten metal it may be convenient to locate one specific aperture (32, 33, 34) of a refractory insert plate 28 only partially in front of the vessel outlet 4.

The flow of molten metal may not only be changed in a discrete manner by changing the aperture 30, 31, 32 which is positioned in front of the vessel outlet 4, according to one relatively fast forward or reverse rotation of the rotary slide gate mechanism of the invention, but said flow of molten metal may also be regulated in a practically uniform manner by moving the mechanism of the invention at another, slower, forward or reverse speed, so as to uniformly modify the coinciding portion of the aperture 32, 33, 34 in the refractory insert plate 28 and the aperture in the upper plate 5, by a kind of throttling effect.

The regulation of the flow of molten metal may thereby be performed by a manual control of the movement of the mechanism, or by automatic control means acting on the movement of the mechanism, and adjusting the position and movement of the suitable carriage 10 as a function of the changing flow of molten metal through the vessel outlet 4. Such automatic control means could for instance conveniently be electrical.

The slide gate mechanism according to this invention thus allows a safe control of the flow of molten metal through at least one outlet in a pour vessel shell, whereby the moving refractory insert plates are closely self adjusting to the upper plate of the vessel outlet and are at their work position always urged by a constant and positive pressure towards the vessel outlet.

The force supplying means bringing about said constant and positive pressure, which may in particular be selected from springs, hydraulic or pneumatic jacks, counterweights, magnets, electromagnets etc., are located out of the heat radiating area of the vessel outlet, thus avoiding or reducing the damages and wear of the force supplying means caused by the contact with hot elements and the exposure to heat radiation.

The various characteristic arrangements of the slide gate mechanism according to the invention result in a number of interesting properties, which are a consequence of or come in addition to the advantages and possibilities of the mechanism already stated in the above description:

—the mechanism is safe in operation,

—the mechanism is easy in maintenance,

—the mechanism allows the use of a reduced number of force supplying means,

—the mechanism allows a reduced perfection in the quality of the plate dimensional manufacturing and finishing, —the mechanism allows reduced wear of its various parts, in particular of its refractory insert plates and of the force supplying means, —the mechanism allows choice of multiple apertures for controlling flow of molten metal, —the mechanism occupies but little space on the vessel shell, owing to its compactness.

In view of the above specification of the invention it must be evident that said invention is not limited to the details disclosed in the specific description hereabove of one embodiment thereof, and that numerous modifications may be provided to said details without leaving the general outline of the invention.

Thus whereas the invention has been specifically described with reference to an embodiment in which the closed loop path of the carriages has one particular shape, it must be clear that other embodiments are readily conceivable, such as for instance embodiments in which the closed loop path is circular, elliptical, pseudotriangular, etc.

Thus also, whereas the invention has been described specifically with reference to a pour vessel having one outlet, the slide gate mechanism according to the invention could easily be adapted to work on a pour vessel having more than one outlet, whereby two or more outlets could work intermittently or simultaneously. Such a slide gate mechanism according to the invention adapted for more than one outlet in the vessel bottom should of course comprise one pushing system for each work position of the mechanism.

In the same manner, whereas the invention has been described specifically with reference to a mechanism in which the system for imparting a movement to the carriages comprises a driving chain, a cog-wheel, a driving gear-wheel, an electro-motor and transmission gears, it must be clear that any system producing movement of the carriages could be applied and that this movement could for instance be achieved by using pinions, gears, pulleys, etc., which may also be external to the mechanism.

What is claimed is:

1. A slide gate mechanism for use on a pour vessel to control flow of molten metal through at least one outlet in the vessel shell, said mechanism comprising:

a guiding system comprising elongated conveyor means defining a closed loop path which runs substantially perpendicular to the axis of the outlet in the vessel shell, fixed to the vessel shell;

a plurality of movable carriages supported and guided along said closed loop path by said guiding system;

a plurality of refractory plate supporting frames, each connected to one carriage on the carriage side facing the outside of said closed loop path, by means of a connection allowing each supporting frame to swivel on the one end in a rotation plane which is perpendicular to said closed loop path, and on the other end around a rotation axis which is perpendicular to the axis of the rotation of said supporting frame in said perpendicular rotation plane;

a plurality of interchangeable refractory insert plates each supported by one supporting frame in such a manner that each refractory plate is able to swivel around an axis which is substantially parallel to the axis of the rotation of said supporting frame in said perpendicular rotation plane, whereby at least one of said refractory plates has an aperture which may be brought in alignment with the outlet in the vessel shell and whereby the movement of the carriages and the lateral edges of the refractory insert plates are so adapted that the refractory insert plates conveyed by two adjacent carriages form with respect to each other a substantially tight seal, when positioned in front of the outlet in the vessel shell;

a pushing system urging said refractory plate supporting frames, when they are in the vicinity of the outlet in the vessel shell, towards said outlet, said system comprising lever means and force supplying means, removed from the heat radiating area of said outlet, acting on said lever means;

driving means for moving said carriages along said closed loop path; whereby the refractory insert plates may be moved in very close cooperating contact with a perforated refractory plate for the outlet in the vessel shell, so as to control the flow of metal therethrough.

2. A slide gate mechanism according to claim 1, which may, as a whole, be connected to and removed from said pour vessel on which it is to be used.

3. A slide gate mechanism according to claim 1, in which the guiding system consists of two parallel guiding rails.

4. A slide gate mechanism according to claim 3, in which the two parallel guiding rails are superimposed so as to form a closed loop track, the surface of which is substantially parallel to the axis of the outlet in the vessel shell.

5. A slide gate mechanism according to claim 3, in which each carriage comprises four supporting means, two of which are supported and guided by each guiding rail.

6. A slide gate mechanism according to claim 5, in which the four supporting means consist of four wheels rolling in the track of said rails.

7. A slide gate mechanism according to claim 1, in which each movable carriage is provided with a supporting frame support hinged thereto by means of a connection allowing said supporting frame support to swivel in a rotation plane which is perpendicular to said closed loop path whereby each supporting frame support is connected to one supporting frame support by means of a spindle of said supporting frame extending into a corresponding bore of said supporting frame support, in a direction which is perpendicular to the axis of the rotation of said supporting frame support in said perpendicular rotation plane, thus allowing the swiveling movement of said supporting frame around a rotation axis coinciding with said perpendicular direction, whereby the supporting frame support, is able to swivel, together with said supporting frame in said perpendicular rotation plane.

8. A slide gate mechanism according to claim 7, in which each supporting frame support is connected to its movable carriage by means of coaxial spindles extending in corresponding bores, in a direction perpendicular to the perpendicular rotation plane of said supporting frame support, thus allowing the swiveling movement of said supporting frame support together with said supporting frame in said perpendicular rotation plane.

9. A slide gate mechanism according to claim 1, in which each refractory insert plate bears upon one supporting frame by means of a hinge, the swivel axis of which is substantially parallel to the axis of the rotation of said supporting frame in said perpendicular rotation plane.

10. A slide gate mechanism according to claim 9, in which each refractory insert plate comprises two coaxial pins adapted to pivot in two notches of one supporting frame.

11. A slide gate mechanism according to claim 9, in which each refractory insert plate comprises two notches adapted to pivot on two coaxial pivots of one supportng frame.

12. A slide gate mechanism according to claim 1, in which the lever means of the pushing system urging the refractory plate supporting frames, when they are in the vicinity of the outlet in the vessel shell, towards said outlet, has its fulcrum located between the point where the lever means urges said refractory plate supporting frames and the point where said force supplying means act upon said lever means.

13. A slide gate mechanism according to claim 12, in which the lever means act upon the refractory plate supporting frame.

14. A slide gate mechanism according to claim 12, in which the lever means act upon the supporting frame support.

15. A slide gate mechanism according to claim 12, in which the fulcrum of the lever means is positioned in the inner area of the closed loop path, whereby one extremity of the lever means is adapted to urge said refractory plate supporting frames towards the outlet in the vessel shell, whereas the other extremity of the lever means extends in an opposite direction to a point removed from the heat radiating area of said outlet, where the force supplying means are located.

16. A slide gate mechanism according to claim 1, in which the lever means comprises near its end acting upon the refractory plate supporting frames, a transverse beam, the length of which is such that it can only be in contact with one refractory plate supporting frame at the same time.

17. A slide gate mechanism according to claim 1, in which the pushing system urging the refractory plate supporting frame in the vicinity of one outlet in the vessel shell, comprises three levers, each of said levers being provided with independent force supplying means, whereby one of said levers urges the refractory plate supporting frame located in front of the outlet in the vessel shell, whereas the two remaining levers are adapted to urge the refractory plate supporting frames approaching and leaving the position in front of the outlet.

18. A slide gate mechanism according to claim 1, in which the force supplying means of the slide gate mechanism are selected from the group comprising springs, hydraulic or pneumatic jacks, counterweights, magnets, and electromagnets.

19. A slide gate mechanism according to claim 1, in which the refractory plate supporting frames consist of forks supporting, in a free swiveling manner, the lateral edges of said refractory insert plates.

20. A slide gate mechanism according to claim 1, in which the driving means for moving said carriages along said closed loop path comprise an endless driving chain dragging said carriages, and a motor actuating said driving chain.

21. A slide gate mechanism according to claim 20, in which the motor is an electromotor.

22. A slide gate mechanism according to claim 20, in which the connection of the driving chain to the carriages is achieved by means of parts which are common to the driving chain and to the carriages.

23. A slide gate mechanism according to claim 1, in which the movement of the carriages along said closed loop track perform in both directions.

24. A slide gate mechanism according to claim 1, in which the movement of the carriages along said closed loop track may be performed at least two different speeds.

25. A slide gate mechanism according to claim 1, in which at least one of the refractory insert plates of the slide gate mechanism has an entirely closed surface of refractory material.

26. A slide gate mechanism according to claim 1, comprising four or more carriages, each conveying one refractory insert plate, arranged along the periphery of the closed loop path.

* * * * *